US010590587B2

(12) United States Patent
Finney et al.

(10) Patent No.: US 10,590,587 B2
(45) Date of Patent: Mar. 17, 2020

(54) APPLIANCE LATCH STRIKER

(71) Applicant: ILLINOIS TOOL WORKS INC., Glenview, IL (US)

(72) Inventors: Joseph M. Finney, Shorewood, WI (US); Randy S. McDonald, Sussex, WI (US)

(73) Assignee: Illinois Tool Works Inc., Glenview, IL (US)

( * ) Notice: Subject to any disclaimer, the term of this patent is extended or adjusted under 35 U.S.C. 154(b) by 594 days.

(21) Appl. No.: 15/032,321

(22) PCT Filed: Nov. 3, 2014

(86) PCT No.: PCT/US2014/063619
§ 371 (c)(1),
(2) Date: Apr. 27, 2016

(87) PCT Pub. No.: WO2015/066580
PCT Pub. Date: May 7, 2015

(65) Prior Publication Data

US 2016/0251793 A1 Sep. 1, 2016

Related U.S. Application Data

(60) Provisional application No. 61/899,462, filed on Nov. 4, 2013.

(51) Int. Cl.
*D06F 37/28* (2006.01)
*E05C 19/06* (2006.01)
(Continued)

(52) U.S. Cl.
CPC ..... *D06F 37/28* (2013.01); *D06F 37/42* (2013.01); *D06F 39/14* (2013.01); *E05B 15/04* (2013.01);
(Continued)

(58) Field of Classification Search
CPC ..... E05C 19/06; D06F 37/28; D06F 37/42; D06F 39/14; D06F 23/04; D06F 2224/00;
(Continued)

(56) References Cited

U.S. PATENT DOCUMENTS 5,174,618 A * 12/1992 Kropf ..... A47L 15/4259 292/254
5,520,424 A 5/1996 Hapke et al.
(Continued)

FOREIGN PATENT DOCUMENTS

DE 3742665 A1 6/1988
DE 19601228 A1 * 7/1997 ..... D06F 37/42
(Continued)

OTHER PUBLICATIONS

Computer Generated Translation for DE 19601228 A1, Generated on Aug. 25, 2018, https://worldwide.espacenet.com/ (Year: 2018).*
(Continued)

*Primary Examiner* — Alyson M Merlino
(74) *Attorney, Agent, or Firm* — Boyle Fredrickson, S.C.

(57) ABSTRACT

A latch system provides a latch striker including a flexible arm that can navigate a hook on the latch striker through an aperture in a corresponding latch mechanism. The aperture provides a tortuous passageway through which a hook on the latch striker must pass to activate an internal switch allowing operation of the appliance.

16 Claims, 5 Drawing Sheets

(51) Int. Cl.

| | |
|---|---|
| ***D06F 39/14*** | (2006.01) |
| ***E05B 63/24*** | (2006.01) |
| ***D06F 37/42*** | (2006.01) |
| ***E05B 15/04*** | (2006.01) |
| ***E05B 17/00*** | (2006.01) |
| ***E05B 65/06*** | (2006.01) |
| ***E05C 3/12*** | (2006.01) |
| *E05B 47/00* | (2006.01) |
| *D06F 23/04* | (2006.01) |

(52) U.S. Cl.
CPC ..... *E05B 17/0054* (2013.01); *E05B 63/248* (2013.01); *E05B 65/06* (2013.01); *E05C 3/12* (2013.01); *E05C 19/06* (2013.01); *D06F 23/04* (2013.01); *D06F 2224/00* (2013.01); *E05B 2015/0455* (2013.01); *E05B 2015/0468* (2013.01); *E05B 2047/0069* (2013.01); *Y10S 292/69* (2013.01)

(58) Field of Classification Search
CPC .... E05B 15/04; E05B 15/022; E05B 15/0225; E05B 15/024; E05B 15/0255; E05B 2015/0455; E05B 2015/0468; E05B 2015/0265; E05B 2015/027; E05B 2015/0275; E05B 17/0054; E05B 17/0058; E05B 63/248; E05B 65/06; Y10T 292/0894; Y10T 292/0911; Y10T 292/0926; Y10T 292/0934; Y10T 292/0902; Y10T 292/0948; Y10T 292/68; Y10T 292/696; Y10T 292/702; Y10T 292/705; Y10T 292/707; Y10T 292/438; A47L 15/4259; Y10S 292/36; Y10S 292/69; Y10S 292/38
See application file for complete search history.

(56) References Cited

U.S. PATENT DOCUMENTS

| | | | | |
|---|---|---|---|---|
| 5,823,017 | A | 10/1998 | Hapke et al. | |
| 5,884,949 | A * | 3/1999 | Leon | G09F 3/0317 292/318 |
| 6,145,898 | A * | 11/2000 | Onderka | D06F 37/42 292/198 |
| 6,363,755 | B1 | 4/2002 | Hapke et al. | |
| 6,568,719 | B2 * | 5/2003 | Buscella | D06F 39/14 292/128 |
| 6,893,061 | B2 * | 5/2005 | Miller | A47L 15/4259 292/121 |
| 7,251,961 | B2 | 8/2007 | Hapke et al. | |
| 2001/0044988 | A1 | 11/2001 | Buscella | |
| 2003/0116936 | A1 * | 6/2003 | Felsing | B60G 3/14 280/124.166 |
| 2008/0202351 | A1 * | 8/2008 | Voss | A47J 37/0786 99/337 |
| 2011/0265271 | A1 * | 11/2011 | Kim | D06F 37/42 8/137 |
| 2012/0312594 | A1 * | 12/2012 | Hapke | D06F 37/42 174/668 |
| 2014/0042881 | A1 * | 2/2014 | Brown | D06F 37/42 312/222 |

FOREIGN PATENT DOCUMENTS

| | | | | |
|---|---|---|---|---|
| DE | 102007034407 | A1 * | 2/2008 | E05B 15/022 |
| GB | 1528401 | A | 10/1978 | |
| WO | 2011109235 | A1 | 9/2011 | |

OTHER PUBLICATIONS

Computer Generated Translation for DE 3742665 A1, Generated on Apr. 12, 2019, https://worldwide.espacenet.com/ (Year: 2019).*
ISR and WO for PCT/US2014/063619 dated May 15, 2015.

* cited by examiner

APPLIANCE LATCH STRIKER

CROSS-REFERENCE TO RELATED APPLICATIONS

This application is a National Phase of International Application No. PCT/US2014/063619, filed Nov. 3, 2014, and claims the benefit of U.S. provisional application 61/899,462 filed Nov. 4, 2013, and hereby incorporated in its entirety by reference.

FIELD OF THE INVENTION

The present invention relates to home appliances such as clothes washing machines and the like and, in particular, to a lid locking mechanism that is highly resistant to tampering.

BACKGROUND OF THE INVENTION

The spin cycle of a washing machine removes water centrifugally from wet clothes by spinning the clothes at high speed in a spin basket. In order to reduce the possibility of injury to the user during the spin cycle, it is known to use an electronically actuated lock for holding the washing machine lid in the closed position. U.S. Pat. Nos. 6,363,755; 5,823,017; and 5,520,424, assigned to the present assignee and hereby incorporated by reference, describe several locking mechanisms.

In order to prevent tampering with the lock mechanism, for example, by holding the lid open when the lock is actuated, it is known to provide for lid closure sensing to ensure that the lid is in a proper position before the lock mechanism is engaged. Conventional mechanical lid closure switches can often be defeated by wedging the switch open, for example, with the end of a pencil or the like. U.S. Pat. No. 7,251,961, assigned to the assignee of the present invention and hereby incorporated by reference, describes a lid sensor using a magnet and electrical reed switch to detect lid closure. The use of a magnetic actuator reduces the possibility of casual tampering.

US patent application 2012/0312594, assigned to the assignee of the present invention and hereby incorporated by reference, describes a lock mechanism in which the magnet is incorporated into a hook or striker that engages the latch. The magnet activates an anti-tamper feature which indicates that the striker and not a foreign object is engaging the latch. In this design, the striker is spring mounted to follow a serpentine path as it engages the latch. This path further defeats simple tampering by requiring that the striker and engagement of the latch have a particular dimension and are able to navigate flexibly along that path. A similar design that does not require the magnet feature is disclosed in U.S. provisional patent application 61/911,659 also incorporated by reference. Each of the above listed patents and applications is hereby incorporated by reference.

SUMMARY OF THE INVENTION

The present invention provides a simplified striker for use with anti-tamper or other latches of a type that require the striker to resist tensile, upward forces caused by attempts to open the door of the appliance when it is latched, but that provides the necessary flexibility to navigate a serpentine engagement path. The latch incorporates a single piece design where resilient elements of a molded element provide the necessary flexure and spring biasing. Proper configuration of the hinge may limit the flexibility to a single pivot axis resisting sideward force and limiting pivot angle to protect the striker from over-flexure. A floating mounting may be provided to automatically align the striker with the latch rather than bend the latch.

Specifically, in one embodiment the invention provides a latch system having a latch striker with a base providing a mounting surface for abutment against a surface of an appliance lid to stably support the base against the appliance lid. Attached to the base is an arm extending outward from the base along an arm axis and terminating in a hook. The hook extends from an end of the arm removed from the base in a hook direction along a hook axis substantially perpendicular to the arm axis. A resilient connection joins the base and arm and allows flexure along the hook axis from an initial position under force along the hook axis to change an angle of the latch hook axis with respect to the base and returns to the initial position after removal of the force and further resists flexure of the arm perpendicular to both the hook axis and the arm axis under the force.

In use the latch striker is received by a latch having a housing providing a mounting surface for stably supporting the housing against an appliance lid-receiving portion of the appliance. The latch includes an electrical switch contained in the housing for actuation by the latch hook and an aperture for receiving the arm and hook therethrough, the aperture requiring a flexure of the resilient connection along the hook axis, as the hook moves through the aperture, to actuate electrical switch.

It is thus a feature of at least one embodiment of the invention to provide a lower cost striker for use in a sophisticated appliance latch that requires complex movement of the latch striker within the latch.

The base may include at least two holes adapted to receive mounting screws passing in part through the surface of the appliance lid and received within the two holes.

It is thus a feature of at least one embodiment of the invention to provide a robust method of attaching the striker to a variety of appliance lids.

The two holes may include two collars extending from corresponding shoulders around the holes so that the collars may fit through a slot in the appliance housing with the shoulders abutting a face of the slot to allow adjustment of the base by sliding the collars in the slot.

It is thus a feature of at least one embodiment of the invention to permit lateral adjustment using the same elements used to attach the latch striker to the appliance for additional cost savings.

The hook may include lateral surfaces perpendicular to the hook axis sloping outward along the arm axis toward the base and the aperture may provide funneling surfaces receiving the lateral surfaces of the hook to center the hook within the aperture in a direction perpendicular to the hook axis.

It is thus a feature of at least one embodiment of the invention to provide a self-aligning striker that accommodates minor tolerance variations in the location of the appliance lid.

The collars may be sized to extend through and beyond a material of the slot to prevent a machine screw installed in the holes from tightening against a material of the slot.

It is thus a feature of at least one embodiment of the invention to retain the base against the appliance while allowing lateral sliding of the base to accommodate a self-aligning feature.

The collars may extend away from the base along the arm axis toward the hook.

It is thus a feature of at least one embodiment of the invention to permit the base to be installed under a rolled lip of a sheet steel appliance lid for reduced height.

The resilient connection may be a torsion bar extending from a proximal end of the arm perpendicular to the hook axis and the arm axis.

It is thus a feature of at least one embodiment of the invention to provide a high torsion spring that can be fabricated of injection molded thermoplastic material and that provides for differentiated resilience allowing lower flexure forces along the hook axis and higher flexure forces perpendicular to the hook axis and the arm axis.

The torsion bar may extend respectively in opposite directions from the proximal end of the arm toward separate portions of the base each including one of the two holes.

It is thus a feature of at least one embodiment of the invention to provide balanced restoring forces that resist twisting along the arm axis.

The resilient connection may be narrowing that reduces a thickness of the arm near the base as measured parallel to the hook axis.

It is thus a feature of at least one embodiment of the invention to provide a living hinge design that may be readily fabricated using injection molding processes.

The base may further include stop elements extending on either side of the arm to positively stop flexure of the arm beyond a predetermined range.

It is thus a feature of at least one embodiment of the invention to allow relatively easy flexure of the arm without the risk of over flexure that might weaken or break the arm at the resilient connection.

The stop elements may comprise interengaging fingers and shoulders, the fingers extending along the arm axis and shoulders abutting axial ends of the fingers, the fingers and shoulders on opposite ones of the base and arm.

It is thus a feature of at least one embodiment of the invention to provide a stop that can be fabricated of relatively thin thermoplastic elements by providing an abutment between the stop and the fingers that puts the thermoplastic material in compression.

The base, arm, hook, and resilient connection may be integrally formed of a thermoplastic material and the resilient connection provides a living hinge.

It is thus a feature of at least one embodiment of the invention to provide a latch striker that can be molded entirely of thermoplastic material for low cost and corrosion resistance.

Other features and advantages of the invention will become apparent to those skilled in the art upon review of the following detailed description, claims and drawings in which like numerals are used to designate like features.

Figure 1:
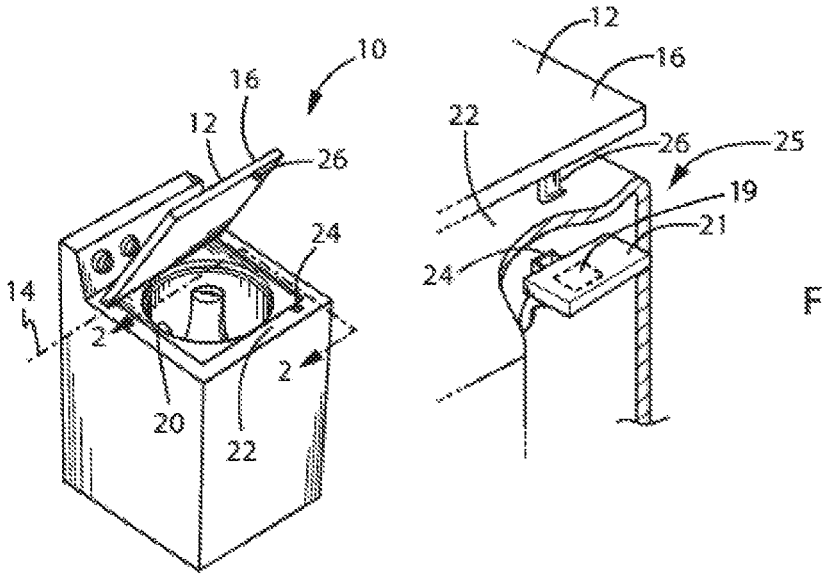
FIG. 1 is a perspective view and inset detail of a top loading washing machine suitable for use with the present invention showing a strike aperture positioned near the front of an upwardly opening lid and showing a downwardly extending striker for engaging the strike aperture and a latch when the lid is closed.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENT

Referring now to FIG. 1, a top loading washing machine 10 suitable for use with the present invention includes a lid 12 opening upward about a horizontal lid hinge axis 14. The lid hinge axis 14 is positioned near the top rear edge of the washing machine 10 so that a front edge 16 of the lid 12 may raise and lower to expose and cover an opening 20 through which clothing may be inserted into the spin basket. A front-loading washing machine (not shown) is also suitable for use with the present invention as will be apparent to those of ordinary skill in the art from the following description with an appropriate adjustment of the orientation.

A horizontal surface of the top 22 of the washing machine 10, at the periphery of the opening 20, may support a strike aperture 24 formed in a housing 21 of a latch 25 fastened to the underside of the top 22, with a switch 19 contained in the housing 21. The strike aperture 24 opens upward to receive a downwardly extending striker 26 attached to an underside of the lid 12. Both the strike aperture 24 and the striker 26 may be offset parallel to the axis 14 and offset from a center of the front edge 16 so as to minimize interference with loading and unloading the washing machine 10.

Figure 2:
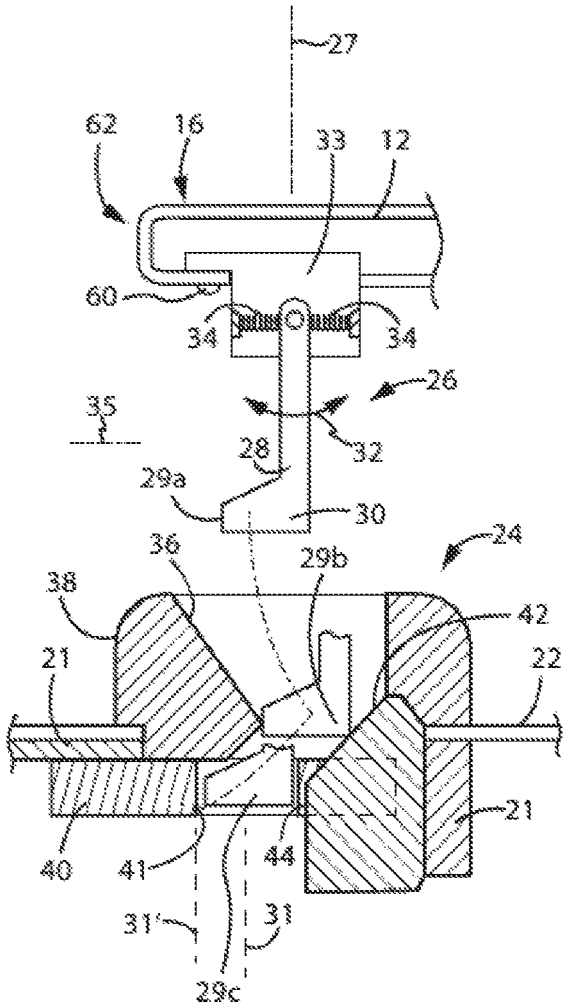
FIG. 2 is a fragmentary cross-section along line 2-2 of FIG. 1 showing a floating mounting of the striker allowing close tolerance interaction between the striker and a latch to move a trap element within the latch to a retaining and locking position.

Referring now to FIG. 2, the striker 26 may include a downwardly extending arm 28 along arm axis 27 terminating in a hook 30 extending leftward from the arm 28, as shown in FIG. 2, generally toward a user of the washing machine 10 along a hook axis 35. The upper end of the arm 28 may be mounted to the lid 12 via a base 33 for longitudinal pivoting 32 (left and right as indicated by arrows in FIG. 2) generally along the hook axis 35 with respect to the lid 12 under restoring spring forces indicated schematically by springs 34. In this way, the left and right surfaces of the hook 30 may translate longitudinally as may be necessary to accommodate positional tolerances in the manufacture of the washing machine 10 and wear of the washing machine 10 and importantly to provide movement of a trap to be described.

As the lid is closed, the hook 30 moves toward the strike aperture 24 and is guided rightward by a right facing first sloping edge 36 of an aperture bezel 38 defining the strike aperture 24. The aperture bezel moves the hook 30 to position 29*b* with a left edge of the striker 26 aligned at first position 31 with the right edge of an un-retracted trap 40 (shown in a retracted position in FIG. 2). The striker 26 is then urged left by a left facing second sloping edge 42 so as to push the trap 40 leftward against a restoring spring (not shown in FIG. 2) so that a left edge of an opening in the trap 40 is moved to position 31' as hook 30 passes to position 29*c*.

A following surface 44 of the trap 40, when the trap is retracted with the striker 26 in position 29*c*, prevents rightward movement of the hook 30 trapping it beneath a ledge on the underside of the sloping edge 36. This serpentine path defined by sloping edges 36 and 42 ensures that the left edge of the striker 26 abuts the left edge 41 of the trap 40 in close proximity despite tolerance variations between the lid 12 and the top 22 and allows the striker 26 to move the trap 40 to the retracted position needed for locking as will be described. It will be understood that the dimensions of the hook 30 are important in ensuring movement of the trap 40 thus reducing the risk of tampering by insertion of an element, for example, like a rod of uniform cross-section.

Figure 3:
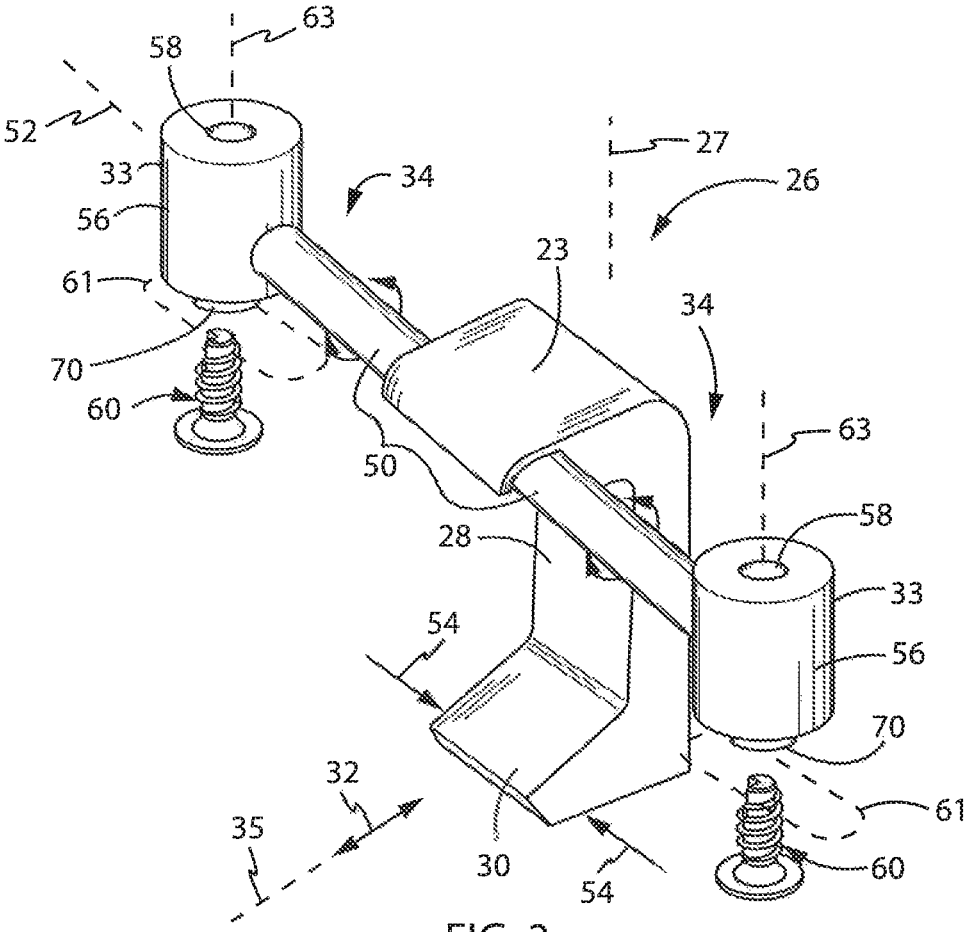
FIG. 3 is a perspective view of the first embodiment of a one-piece molded striker providing the necessary floating mounting through a torsion bar.

Referring now to FIG. 3, the striker 26 may be formed of a single injection molded thermoplastic element in which the arm 28 extends upward from the hook 30 to attach to a torsion bar 50 communicating with a sockets 56 forming the base 33. The upper end of the arm 28 may include an offset portion 23 extending longitudinally from the upper end of the arm 28 to the torsion bar 50 whose purpose will be described below. The torsion bar 50 extends transversely along a pivot axis 52 from the left and right sides of the top of the arm 28. As such, the torsion bars 50 provide a resilient connection between the arm 28 and the base 33 that implements the springs 34 to allow longitudinal pivoting 32 of the hook 30 as discussed above through elastic twisting of the torsion bar 50 under force on the hook 30 along the hook axis 35. This twisting is sufficient to provide at least three degrees of deflection of the arm 28 from a normal position where the torsion bars 50 are relaxed and the arm 28 extends downward substantially perpendicular to a plane of the appliance lid 12 (shown in FIG. 1). The torsion bars 50 operate within their elastic limit to return the hook 30 to a normal position when that force is removed.

The pivot axis 52 is generally transverse and perpendicular to the arm axis 27 and the hook axis 35. Any transverse forces 54 acting on the hook 30 are nevertheless resisted by the torsion bars 50 and instead provide a net left or right transverse force on the striker 26 along the pivot axis 52 that may be used for self-alignment as will be discussed.

Opposite ends of the torsion bar 50 extending from the upper end of the arm 28 attached to mounting sockets 56, described above, each provide vertically extending through-bores 58 through which machine screws 60 may be inserted upward along insertion axis 63 to attach the sockets 56 to a lip of the lid 12 extending along the underside of the lid 12.

Figure 4:
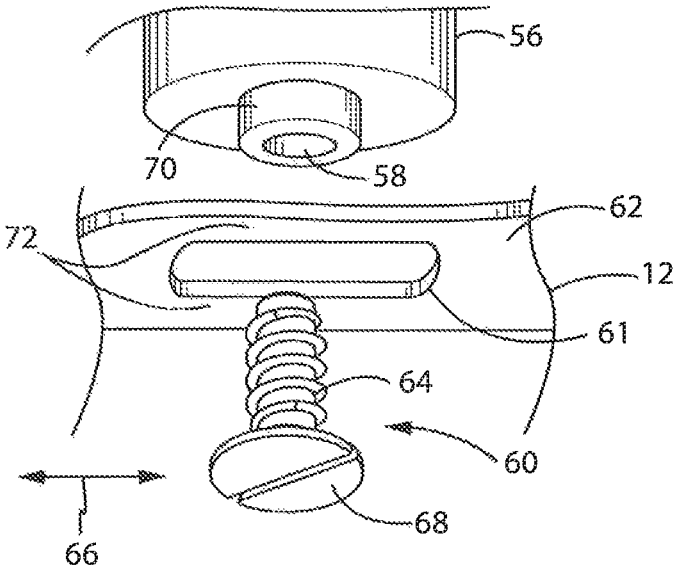
FIG. 4 is a fragmentary detail of the mounting element of the striker of FIG. 3 showing its engagement with a slot in the lid for sideward adjustability.
Figure 5:
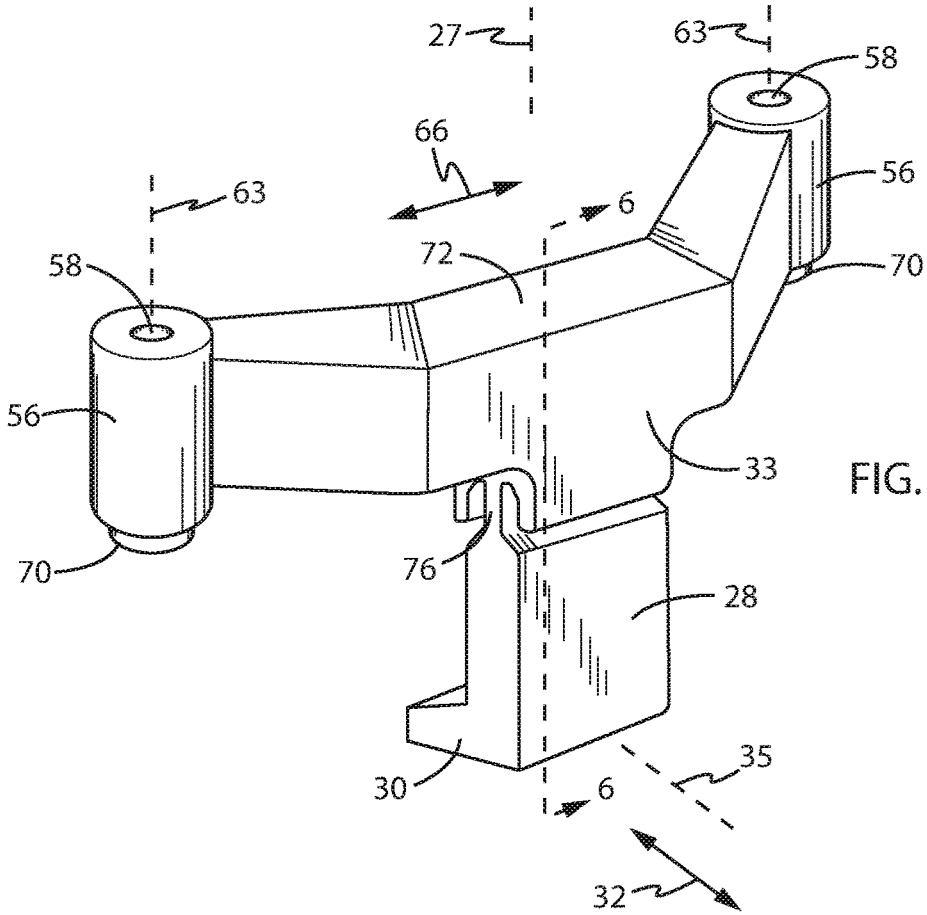
FIG. 5 is an alternative embodiment of the striker of FIG. 3 providing the necessary floating mounting through a living hinge.
Figure 8:
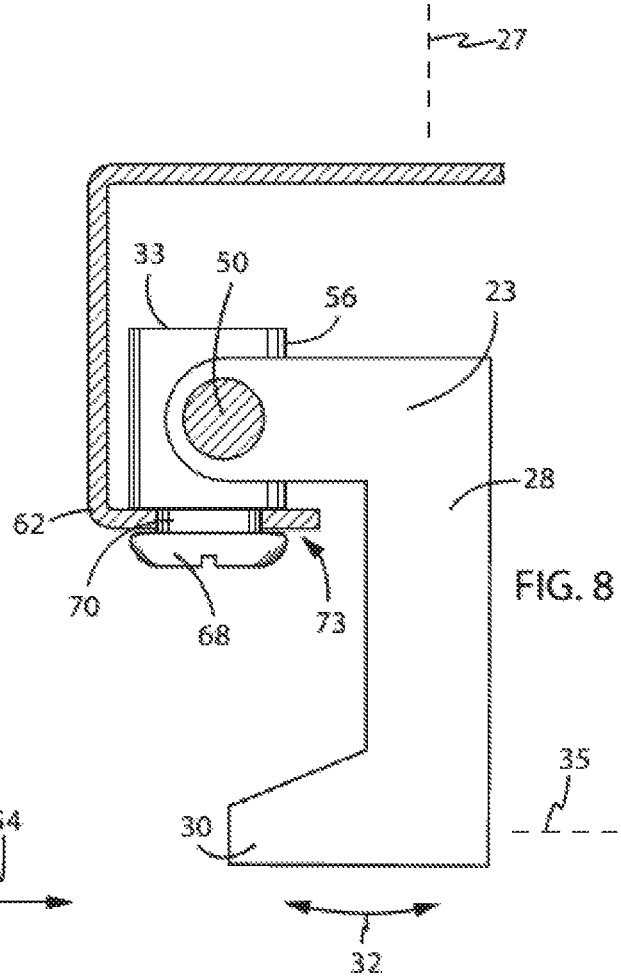
FIG. 8 is a side cross-sectional view of the embodiment of FIG. 3 showing support of the striker on the inside of a lower lip of an appliance lid to reduce striker height while providing flexibility.

Referring now to FIGS. 3, 4 and 5, a lower surface of the mounting sockets 56 may provide shoulders that abut an upper surface of a folded over sheet metal lip 62 forming a front edge 16 of the lid 12 (also shown in FIG. 2). A collar 70 extending downward from each socket 56 coaxially about the bore 58 may fit within a corresponding slot 61 in that lip 62 to slide transversely therein. A machine screw 60, providing a threaded shank 64, may be threadably received within the bore 58 to attach to the sockets 56 so that the head 68 of the machine screw 60 is spaced away from the sheet metal lip 62 by a gap 73 (shown in FIG. 8) so that it slides longitudinally along extending side portions of the slot 61 over the lower surface of the sheet metal lip 62 to retain the sockets 56 against the lip 62 while allowing this transverse motion 66 over a full range of the slot 61. The offset portion 23 of the arm 28 allows the arm 28 to extend downward past the edge of the metal lip 62.

Figure 9:
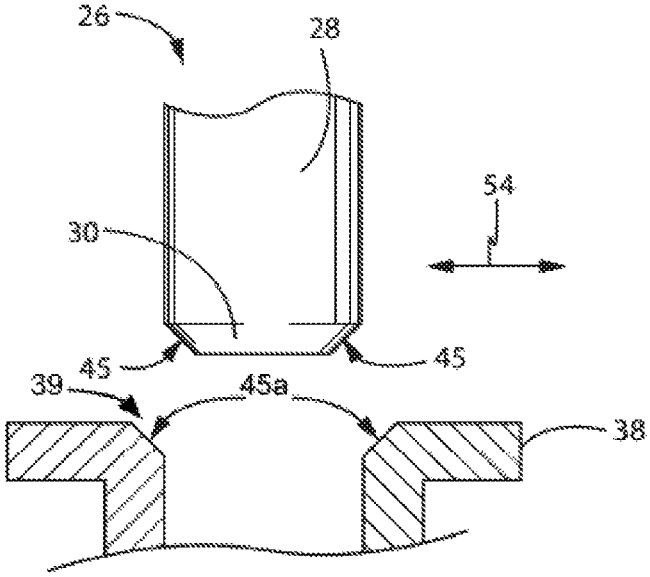
FIG. 9 is a front view of the striker of FIG. 8 showing a beveling of the lateral surfaces of the hook to interact with funnel surfaces of the latch aperture to align the hook within the aperture.

Referring to FIGS. 1 and 9, this transverse motion 66 permits alignment of the striker 26 with the strike aperture 24 in a lateral direction in the face of minor tolerance buildups in the assembly of the appliance. The aperture bezel 38 (for example, shown in FIGS. 2 and 9) may provide for a transverse funneled opening 39 to receive the downwardly extending striker 26 and to center the hook 30 of the striker 26 by guidance of the former within the bezel 38 by initial engagement of sloped lower edges 45 of hook 30 with sloping inner walls 45*a* (FIG. 9) of the bezel 38 which produce these transverse forces 54. The selective resistance of the torsion bars 50 to transverse forces 54, while complying with forces that would produce longitudinal pivoting 32, allows this adjustment to occur by the sliding left or right of the striker 26 without the transverse forces 54 being absorbed by flexure of the striker 26.

Referring now to FIG. 5, in an alternative embodiment, the torsion bars 50 may be replaced with a relatively stiff and torsionally unyielding support frame 72 extending between the mounting sockets 56. The arm 28 of the striker 26 may attach to the underside of the support frame 72 to extend downward therefrom by means of narrowing that forms a living hinge 76, the latter allowing for longitudinal pivoting 32 of the arm 28 by flexure of the living hinge 76 while resisting other bending moments because of a lack of narrowing in the transverse direction. Transverse motion 66 can be provided by the same slot and screw mechanism discussed above with respect to FIGS. 3 and 4.

Figure 6A:
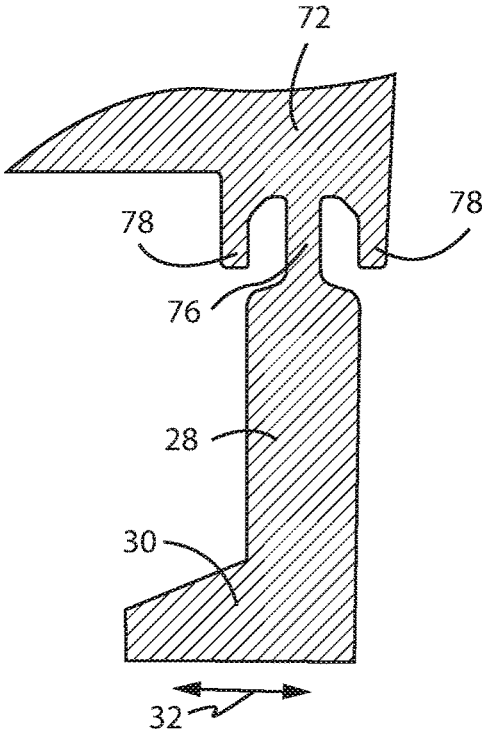
FIGS. 6*a* and 6*b* are cross-sections along lines 6-6 of FIG. 5 showing the living hinge in an unselect and flexed state where the striker abuts a travel stop.
Figure 6B:
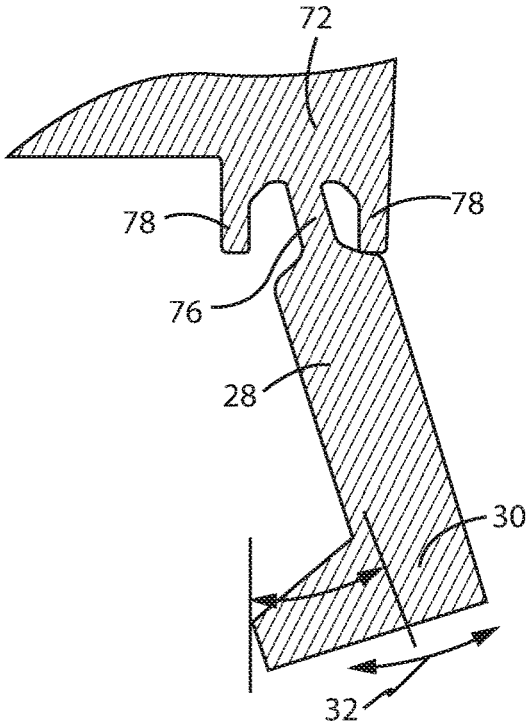
Figure 7:
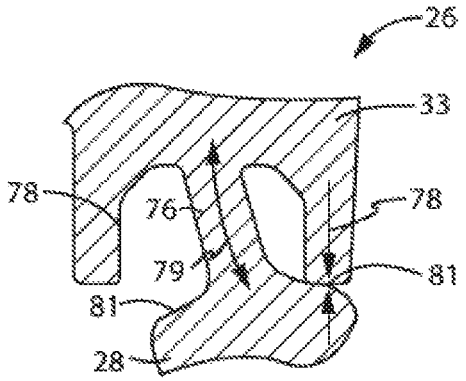
FIG. 7 is a detailed fragmentary view of FIG. 6*b* showing the conversion of bending forces into compression and tension forces accommodated by the striker.

Referring now also to FIGS. 6*a*, 6*b* and 7, the living hinge 76 may be longitudinally flanked by travel stops 78 providing fingers extending downward from the underside of the support frame 72. Flexure of the living hinge 76 in either longitudinal direction beyond an angular range whose magnitude is shown in FIG. 6*b* provides an abutment between an upper longitudinal shoulder 81 of arm 28 below the living hinge 76 and a lower edge of the travel stops 78, this abutment preventing over-flexure of the living hinge 76 such as might damage the living hinge 76. The abutment of the upper edge of the arm 28 and the lower edge of the travel stop 78 converts the force of longitudinal flexure into a tensile force 79 on the living hinge 76 more readily resisted by the living hinge 76 and compression forces on the fingers of the travel stops 78 and the shoulder 81, also easily accommodated by a thermoplastic material.

Each of the hook 30, arm 28, torsion bars 50 or support frame 72, and sockets 56 may be formed as a single, integrated injection molded component requiring no postmolding assembly. Suitable thermoplastic materials include nylon, polyethylene, and polypropylene, the latter two of which have excellent fatigue resistance.

Figure 10:
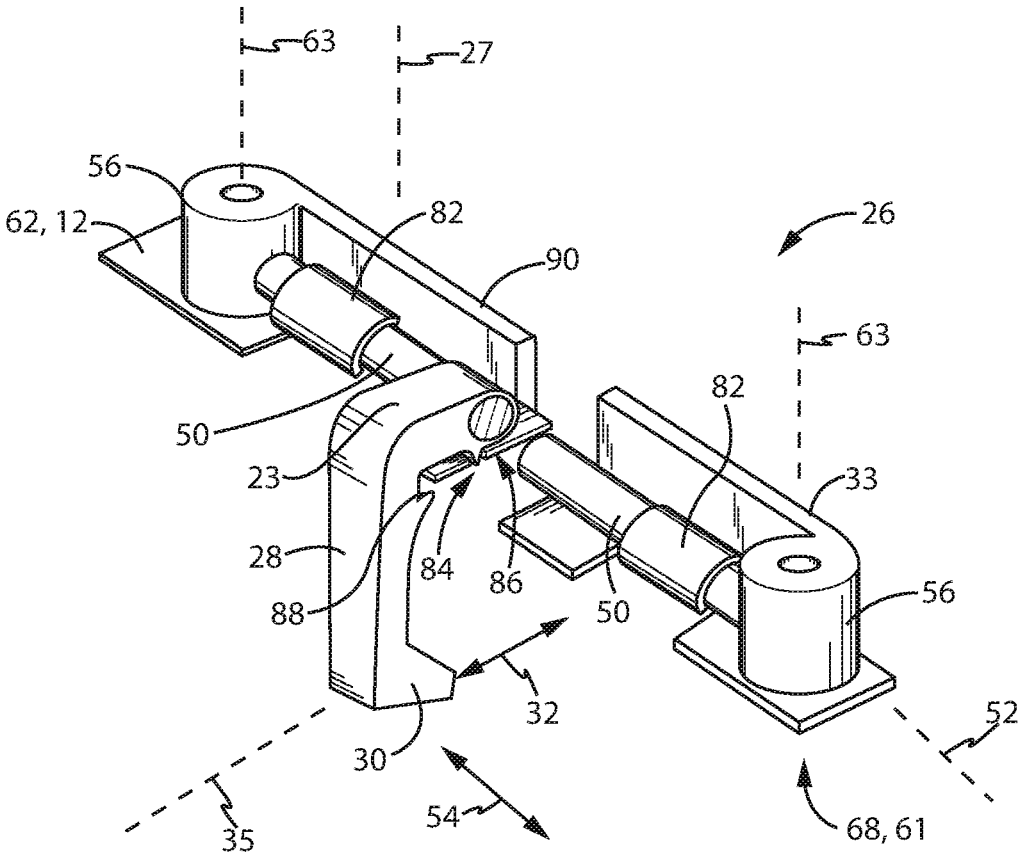
FIG. 10 is a figure similar to FIG. 3 but viewed from the opposite direction and of an alternative embodiment including additional stabilizing features.

Referring now to FIG. 10, additional stabilization of the torsion bars 50 may be provided by curving tabs 82 upward from the sheet metal of the lip 62 of the lid 12 to curve around the torsion bars 50 between the sockets 56 and the offset portion 23 to provide a surrounding bearing surface. These tabs 82 may be formed when the striker 26 is in place. In addition, the point of attachment of the offset portion 23 to the torsion bars 50 is rounded so that it may provide a bearing surface against the upper surface of the lip 62 during movement. A lower face of the offset portion 23 may provide a downwardly extending tooth 84 passing into a corresponding slot 86 in the sheet metal of the lip 62 to transfer force into the sheet metal when the lid 12 is pulled open while locked. A rear surface of the arm 28 near the lip 62 extends in a hook 88 that may engage the lower surface of the sheet metal 62 to protect the torsion bars 50 if the lid 12 is slammed during closure. Finally a stabilizer bar 90 may extend between the sockets alongside of the torsion bar 50 to provide additional strength to the base 33.

Certain terminology is used herein for purposes of reference only, and thus is not intended to be limiting. For example, terms such as "upper", "lower", "above", and "below" refer to directions in the drawings to which reference is made. Terms such as "left", "right", "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A latch system for an appliance, the latch system comprising:

a latch striker formed of a single piece of thermoplastic and having:

(a) a base providing a mounting surface for abutment against a surface of an appliance lid of the appliance to stably support the base against the appliance lid;

(b) an arm extending outward from the base along an arm axis;

(c) a hook extending from an end of the arm removed from the base in a hook direction along a hook axis substantially perpendicular to the arm axis; and (d) a resilient connection joining the base and arm and allowing flexure of the arm along the hook axis from an initial position under a force along the hook axis to change an angle of the arm with respect to the base and return of the arm to the initial position after removal of the force, and resisting flexure of the arm perpendicular to both the hook axis and the arm axis under the force;

wherein the base provides left and right extensions perpendicular to the arm axis and terminating at holes receiving mounting screws; and a latch having:

(a) a housing providing a mounting surface for stably supporting the housing against an appliance lid-receiving portion of the appliance;

(b) an electrical switch contained in the housing for actuation by the hook of the latch striker; and (c) an aperture for receiving the arm and hook therethrough, the aperture requiring a flexure of the resilient connection along the hook axis, as the hook moves through the aperture, to actuate the electrical switch.

2. The latch system of claim 1 wherein the hook includes lateral surfaces perpendicular to the hook axis sloping outward along the arm axis toward the base, and wherein the aperture provides funneling surfaces receiving the lateral surfaces of the hook to center the hook within the aperture in a direction perpendicular to the hook axis.

3. The latch system of claim 2 wherein the holes include collars extending from corresponding shoulders of the base around the holes so that the collars may fit through respective slots in an appliance housing of the appliance with the shoulders abutting a face of the slots to allow adjustment of the base by sliding the collars in the slots.

4. The latch system of claim 3 wherein the collars are each sized to extend through and beyond a material of a respective one of the slots to prevent the mounting screws installed in the holes from tightening against the material of the respective slots.

5. The latch system of claim 3 wherein the collars extend away from the base along the arm axis toward the hook.

6. The latch system of claim 1 wherein the resilient connection is a torsion bar extending from a proximal end of the arm perpendicular to the hook axis and the arm axis.

7. The latch system of claim 6 wherein the torsion bar extends respectively in opposite directions from the proximal end of the arm toward separate portions of the base each including one of the holes of the base.

8. The latch system of claim 6 wherein the hook provides a rounded bearing surface abutting the surface of the appliance lid with rotation of the hook, and wherein the rounded bearing surface further includes a tooth element extending into a corresponding opening in the appliance lid to stabilize the hook against motion with respect to the appliance lid.

9. The latch system of claim 1 wherein the resilient connection is a narrowing that reduces a thickness of the arm near the base as measured parallel to the hook axis.

10. The latch system of claim 9 wherein the base and arm further provide stop elements extending on either side of the arm axis to positively stop flexure of the arm beyond a predetermined range.

11. The latch system of claim 10 wherein the stop elements comprise interengaging fingers and shoulders, the fingers extending along the arm axis such that the shoulders abut axial ends of the fingers, the fingers and shoulders are located on opposite ones of the base and arm.

12. The latch system of claim 1 wherein the base, arm, hook, and resilient connection are integrally formed with one another and the resilient connection provides a living hinge.

13. A latch striker formed of a single piece of thermoplastic and comprising:

(a) a base providing a mounting surface for abutment against a surface of an appliance lid to stably support the base against the appliance lid;

(b) an arm including an arm offset portion extending outwardly from a torsion bar joining the base and the arm, the arm offset portion extending outwardly from the torsion bar in a first direction to a location that is transversely offset from the abutment of the mounting surface of the base against the surface of the appliance lid, and the arm further including an arm main portion extending outwardly from the torsion bar in a second direction that defines an arm axis, wherein the second direction is perpendicular to the first direction; and (c) a hook extending from an end of the arm removed from the base in a hook direction along a hook axis substantially perpendicular to the arm axis;

wherein the torsion bar allows flexure of the arm along the hook axis from an initial position under a force along the hook axis to change an angle of the hook axis with respect to the base and return of the arm to the initial position after removal of the force, and resisting flexure of the arm perpendicular to both the hook axis and the arm axis under the force; and wherein the torsion bar extends from a proximal end of the arm perpendicular to the hook axis and the arm axis.

14. The latch striker of claim 13 wherein the base includes holes adapted to receive mounting screws passing in part through the surface of the appliance lid and received within the holes.

15. The latch striker of claim 13 wherein the torsion bar extends respectively in opposite directions from the proximal end of the arm toward separate portions of the base with each portion of the base including one of the holes.

16. A latch striker formed of a single piece of thermoplastic and comprising:

(a) a base providing a mounting surface for abutment against a surface of an appliance lid to stably support the base against the appliance lid;

(b) an arm extending outward from the base along an arm axis;

(c) a hook extending from an end of the arm removed from the base in a hook direction along a hook axis substantially perpendicular to the arm axis; and (d) a resilient connection joining the base and arm and allowing flexure of the arm along the hook axis from an initial position under a force along the hook axis to change an angle of the hook axis with respect to the base and return of the arm to the initial position after removal of the force, and resisting flexure of the arm perpendicular to both the hook axis and the arm axis under the force;

wherein the base and arm further provide stop elements extending on either side of the arm axis to positively stop flexure of the arm beyond a predetermined range;

wherein the stop elements comprise fingers extending along the arm axis, and shoulders abutting axial ends of the fingers with flexure of the arm to stop the flexure of the arm beyond the predetermined range, and wherein the fingers and shoulders are located on opposite ones of the base and arm.

* * * * *